US005454334A

United States Patent [19]

Kurono et al.

[11] Patent Number: 5,454,334

[45] Date of Patent: Oct. 3, 1995

[54] CONTROL APPARATUS FOR EMBROIDERY SEWING MACHINE

[75] Inventors: Yoshikazu Kurono, Hazu; Tomoo Hattori, Nagoya, both of Japan

[73] Assignee: Brother Kogyo Kabushiki Kaisha, Nagoya, Japan

[21] Appl. No.: 223,850

[22] Filed: Apr. 6, 1994

[30] Foreign Application Priority Data

Apr. 30, 1993 [JP] Japan ..... 5-127882

[51] Int. Cl.[6] ..... D05B 21/00

[52] U.S. Cl. ..... 112/470.06; 112/103; 112/300; 112/102.5; 112/475.19

[58] Field of Search ..... 112/121.12, 103, 112/285, 288, 291, 292, 300, 293, 296, 163

[56] References Cited

U.S. PATENT DOCUMENTS 3,386,402 6/1968 Ross .
3,424,116 1/1969 von Hagen .
3,728,978 4/1973 Honda et al. .
4,938,157 7/1990 Scholl ..... 112/121.12
5,267,169 11/1993 Yokoe et al. ..... 112/121.12 X

*Primary Examiner*—Peter Nerbun
*Attorney, Agent, or Firm*—Oliff & Berridge

[57] ABSTRACT

A control apparatus for an embroidery sewing machine performs thread trimming with certainty after a thread is cut upon replacing of the thread in the course of an embroidery sewing operation or upon completion of an embroidery sewing operation. The control apparatus detects the position of a movable frame and determines the thread trimming moving direction in which the movable frame is to be moved for thread trimming in accordance with the position of the movable frame and a movable area of the movable frame. In thread trimming, the control apparatus moves the movable frame in accordance with the moving direction and a movement distance for thread trimming.

15 Claims, 12 Drawing Sheets

FIG. 3B

| START OF THREAD TRIMMING CONTROL | |
|---|---|
| S11: | READ MOVING POSITION DATA P(a, b) OF EMBROIDERY FRAME |
| S12: | $b \geq B/2$ ? |
| S13: | YDF ← 0 |
| S14: | YDF ← 1 |
| S15: | YDF = 1 ? |
| S16: | MOVE EMBROIDERY FRAME BY PREDETERMINED DISTANCE IN +Y DIRECTION |
| S17: | MOVE EMBROIDERY FRAME BY PREDETERMINED DISTANCE IN -Y DIRECTION |
| S18: | MOVE EMBROIDERY FRAME BY PREDETERMINED DISTANCE IN -Y DIRECTION |
| S19: | MOVE EMBROIDERY FRAME BY PREDETERMINED DISTANCE IN +Y DIRECTION |
| RETURN | |

FIG. 6B

| START OF THREAD TRIMMING CONTROL | |
|---|---|
| S21: | READ MOVING POSITION DATA P(a, b) OF EMBROIDERY FRAME |
| S22: | $a \geq A/2$ ? |
| S23: | XDF ← 0 |
| S24: | XDF ← 1 |
| S25: | XDF = 1 ? |
| S26: | MOVE EMBROIDERY FRAME BY PREDETERMINED DISTANCE IN +X DIRECTION |
| S27: | MOVE EMBROIDERY FRAME BY PREDETERMINED DISTANCE IN -X DIRECTION |
| S28: | MOVE EMBROIDERY FRAME BY PREDETERMINED DISTANCE IN -X DIRECTION |
| S29: | MOVE EMBROIDERY FRAME BY PREDETERMINED DISTANCE IN +X DIRECTION |
| RETURN | |

FIG. 7B

| START OF THREAD TRIMMING CONTROL | |
|---|---|
| S31: | READ MOVING POSITION DATA P(a, b) OF EMBROIDERY FRAME |
| S32: | $\alpha \geq b \geq 0$ ? |
| S33: | $B \geq b \geq (B-\alpha)$ ? |
| S34: | YDF ← 0 |
| S35: | YDF ← 1 |
| S36: | YDF = 1 ? |
| S37: | MOVE EMBROIDERY FRAME BY PREDETERMINED DISTANCE IN +Y DIRECTION |
| S38: | MOVE EMBROIDERY FRAME BY PREDETERMINED DISTANCE IN -Y DIRECTION |
| S39: | MOVE EMBROIDERY FRAME BY PREDETERMINED DISTANCE IN -Y DIRECTION |
| S40: | MOVE EMBROIDERY FRAME BY PREDETERMINED DISTANCE IN +Y DIRECTION |
| RETURN | |

FIG. 8B

| START OF THREAD TRIMMING CONTROL | |
|---|---|
| S81: | READ MOVING POSITION DATA P(a, b) OF EMBROIDERY FRAME |
| S82: | $\alpha \geq a \geq 0$ ? |
| S83: | $A \geq a \geq (A-\alpha)$ ? |
| S84: | XDF ← 0 |
| S85: | XDF ← 1 |
| S86: | XDF = 1 ? |
| S87: | MOVE EMBROIDERY FRAME BY PREDETERMINED DISTANCE IN +X DIRECTION |
| S88: | MOVE EMBROIDERY FRAME BY PREDETERMINED DISTANCE IN -X DIRECTION |
| S89: | MOVE EMBROIDERY FRAME BY PREDETERMINED DISTANCE IN -X DIRECTION |
| S90: | MOVE EMBROIDERY FRAME BY PREDETERMINED DISTANCE IN +X DIRECTION |
| RETURN | |

CONTROL APPARATUS FOR EMBROIDERY SEWING MACHINE

BACKGROUND OF THE INVENTION

1. Field of the Invention

This invention relates to a control apparatus for an embroidery sewing machine. More particularly, this invention relates to a control apparatus for an embroidery sewing machine of such a type that the moving direction of a movable frame is determined every time in order to trim a thread after the thread is cut to replace the thread in the course or upon completion of an embroidery sewing operation.

2. Description of the Related Art

Conventionally, a multi-needle embroidery sewing machine of a type including a single arm section or a plurality of arm sections is constructed such that a movable frame on which an embroidery frame or a plurality of embroidery frames to which a work fabric or fabrics to be embroidered are to be attached are mounted is supported for movement in an X-axis direction and a Y-axis direction. A needle bar change-over mechanism is provided such that a needle bar is changed over and a thread is cut by a thread cutting mechanism in accordance with embroidery data for each thread replacing operation so that a colorful embroidery can be sewn with a plurality of embroidery threads of different colors while driving the movable frame or frames to move.

By the way, for example, in a multi-needle embroidery sewing machine of a multi-head type, when a thread is cut by means of a thread cutting mechanism to replace the thread or when a thread is cut upon completion of an embroidery sewing operation, it is a common practice to perform thread trimming control. In order to simplify such thread trimming control, the movable frame is moved by a predetermined distance normally in a predetermined direction, for example, in the rightward direction or the leftward direction. Then, an end portion of the cut embroidery thread is trimmed from the work fabric, whereafter the movable frame is moved back by the predetermined distance in the opposite direction as disclosed in Japanese Patent Laid-Open No. 61-63762, published on Apr. 1, 1986.

As described above, in a multi-needle embroidery sewing machine, when a thread is cut and replaced or when an embroidery sewing operation is completed, the movable frame is moved normally in the predetermined direction to effect trimming of the thread. Accordingly, when the needle position in thread trimming is at or around a peripheral portion of an embroidery range of an embroidery frame on the trailing side of the predetermined direction, the movable frame cannot be moved by a distance necessary for thread trimming in the predetermined direction. Particularly, thread trimming is not performed with certainty after the thread is cut. Consequently, the conventional multi-needle embroidery sewing machine is disadvantageous in that sometimes an end portion of a preceding embroidery thread is sewn with a next embroidery thread.

SUMMARY OF THE INVENTION

It is an object of the present invention to provide a control apparatus for an embroidery sewing machine by which thread trimming can be performed with certainty after a thread is cut upon replacing of the thread in the course of an embroidery sewing operation or upon completion of an embroidery sewing operation.

In order to attain the above object and other objects, according to the present invention, there is provided a control apparatus for an embroidery sewing machine of a type including driving means for driving a movable frame on which an embroidery frame is to be set, controlling means for controlling the driving means, and thread cutting means for cutting a thread. The thread cutting means comprises position detection means for detecting the position of the movable frame and moving direction determination means for determining the thread trimming moving direction in which the movable frame is to be moved for thread trimming in accordance with the position of the movable frame detected by the position detection means and a movable area of the movable frame. The controlling means moves, upon thread trimming, the movable frame in accordance with the moving direction determined by the moving direction determination means and a movement distance for thread trimming.

Here, the moving direction determination means may be constructed such that it determines the thread trimming moving direction so that the sewing needle remains within the moving area of the embroidery frame even if the movable frame is moved by the movement distance for thread trimming. Alternatively, the moving direction determination means may be constructed such that it determines the thread trimming moving direction so that the sewing needle is spaced away from a portion of an outer edge of the moving area of the embroidery frame nearest to the same.

With the control apparatus for an embroidery sewing machine constructed as described above, the movable frame on which the embroidery frame is set is driven by the driving means under the control of the controlling means, and the position detection means detects the position of the movable frame. Then, when a thread is cut by the thread cutting means, the moving direction determination means determines the thread trimming moving direction in which the movable frame is to be moved for thread trimming in accordance with the position of the movable frame detected by the position detection means and the movable area of the movable frame. Consequently, the controlling means moves, upon thread trimming, the movable frame in accordance with the moving direction determined by the moving direction determination means and the movement distance for thread trimming.

In this manner, upon thread trimming after the thread is cut, the thread trimming moving direction of the movable frame for thread trimming is determined in accordance with the position of the movable frame and the movable area of the movable frame. So, even if the movable frame is moved by the movement distance for thread trimming, the needle still remains within the movable area of the embroidery frame, and the movable frame is moved by the movement distance for thread trimming in the thus determined moving direction. Accordingly, whatever the positional relationship between the movable frame and the movable area of the movable frame is, the movable frame can be moved by the movement distance for thread trimming after the thread is cut. Thus, the thread can be trimmed with certainty.

BRIEF DESCRIPTION OF THE DRAWINGS

FIG. 3B is a table listing the steps of the flowchart of FIG. 3A;

FIG. 6B is a table listing the steps of the flowchart of FIG. 6A;

FIG. 7B is a table listing the steps of the flowchart of FIG. 7A;

FIG. 8B is a table listing the steps of the flowchart of FIG. 8A.

DESCRIPTION OF PREFERRED EMBODIMENTS

A preferred embodiment of the present invention is described below with reference to the drawings. In the preferred embodiment, the present invention is applied to a multi-needle embroidery sewing machine.

Figure 1:
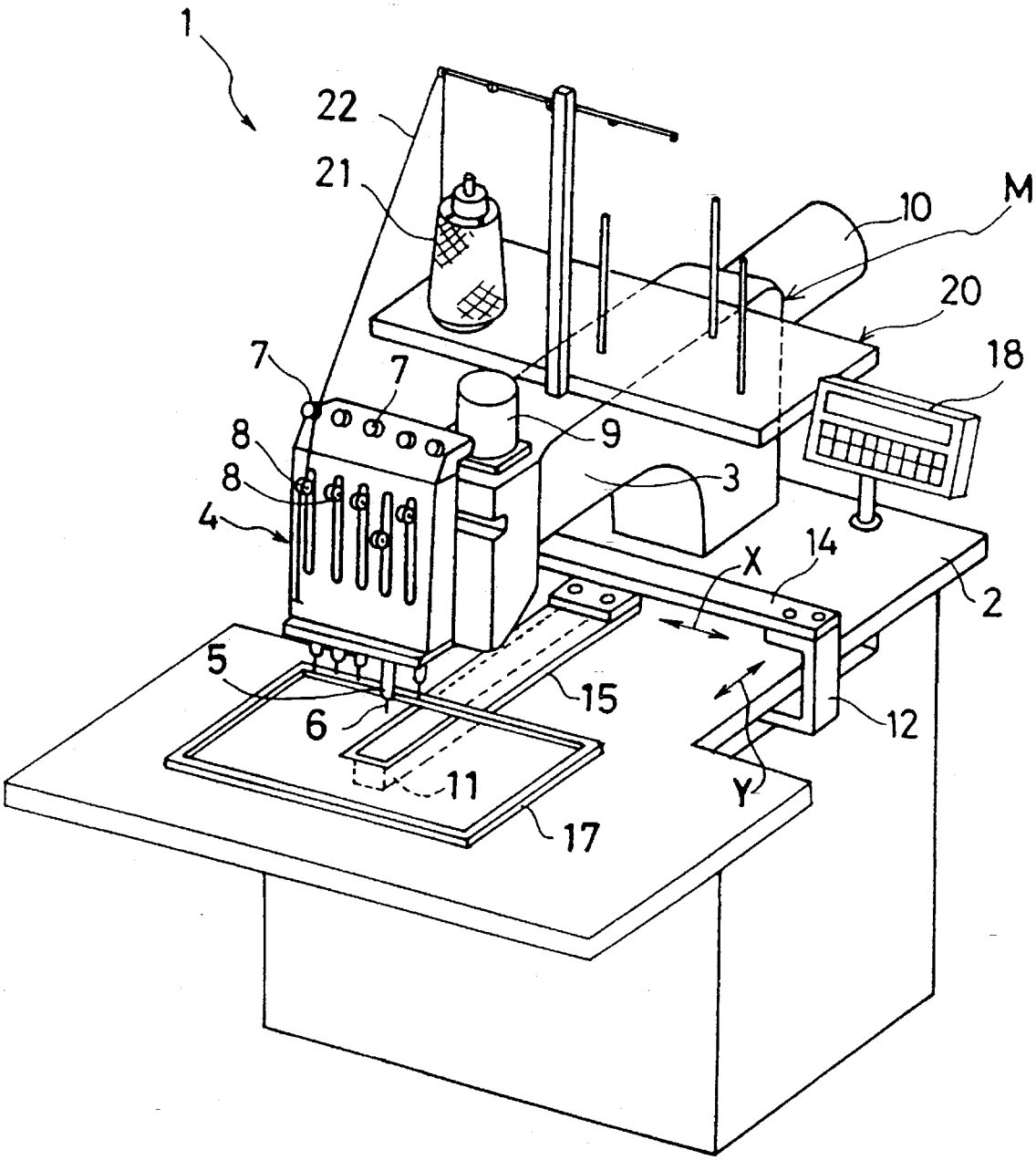
FIG. 1 is a schematic perspective view of a multi-needle embroidery sewing machine according to the present invention.

The multi-needle embroidery sewing machine 1 is shown in FIG. 1. Referring to FIG. 1, an arm section 3 of a sewing machine body M of the multi-needle embroidery sewing machine 1 is disposed above a sewing machine table 2. A needle bar supporting case 4 is mounted for movement in leftward and rightward directions at a front end portion of the arm section 3 and supports five needle bars 5 for individual upward and downward movement thereon. The needle bar supporting case 4 is moved in the leftward or rightward direction when a needle bar changing motor 9 is energized. One of the needle bars 5 selected by such movement of the needle bar supporting case 4 is driven to move upwardly and downwardly by a sewing machine motor 10 when the sewing machine motor 10 is energized. An operation panel 18 having a plurality of switches for embroidery sewing is mounted on the sewing machine table 2.

A sewing needle 6 is mounted at the lower end of each of the needle bars 5, and an embroidery thread 22 supplied from a bobbin 21 on a bobbin table 20 placed on the arm section 3 is supplied to the sewing needle 6 by a corresponding tension device 7 and thread take-up lever 8.

A cylinder bed 11 of the sewing machine body M extends forwardly below the sewing machine table 2. A needle cylinder (thread loop catcher) for cooperating with upward and downward movement of the sewing needle 6 to form a stitch on a work fabric and a thread cutting mechanism for cutting the embroidery thread 22 and a bobbin thread when the embroidery thread 22 is to be replaced or an embroidery sewing operation is completed are provided inside of the cylinder bed 11. The needle cylinder and the thread cutting mechanism are known mechanisms and may be such mechanisms as disclosed, for example, in U.S. Pat. Nos. 3,386,402, 3,424,116, and 3,728,978.

Figure 2:
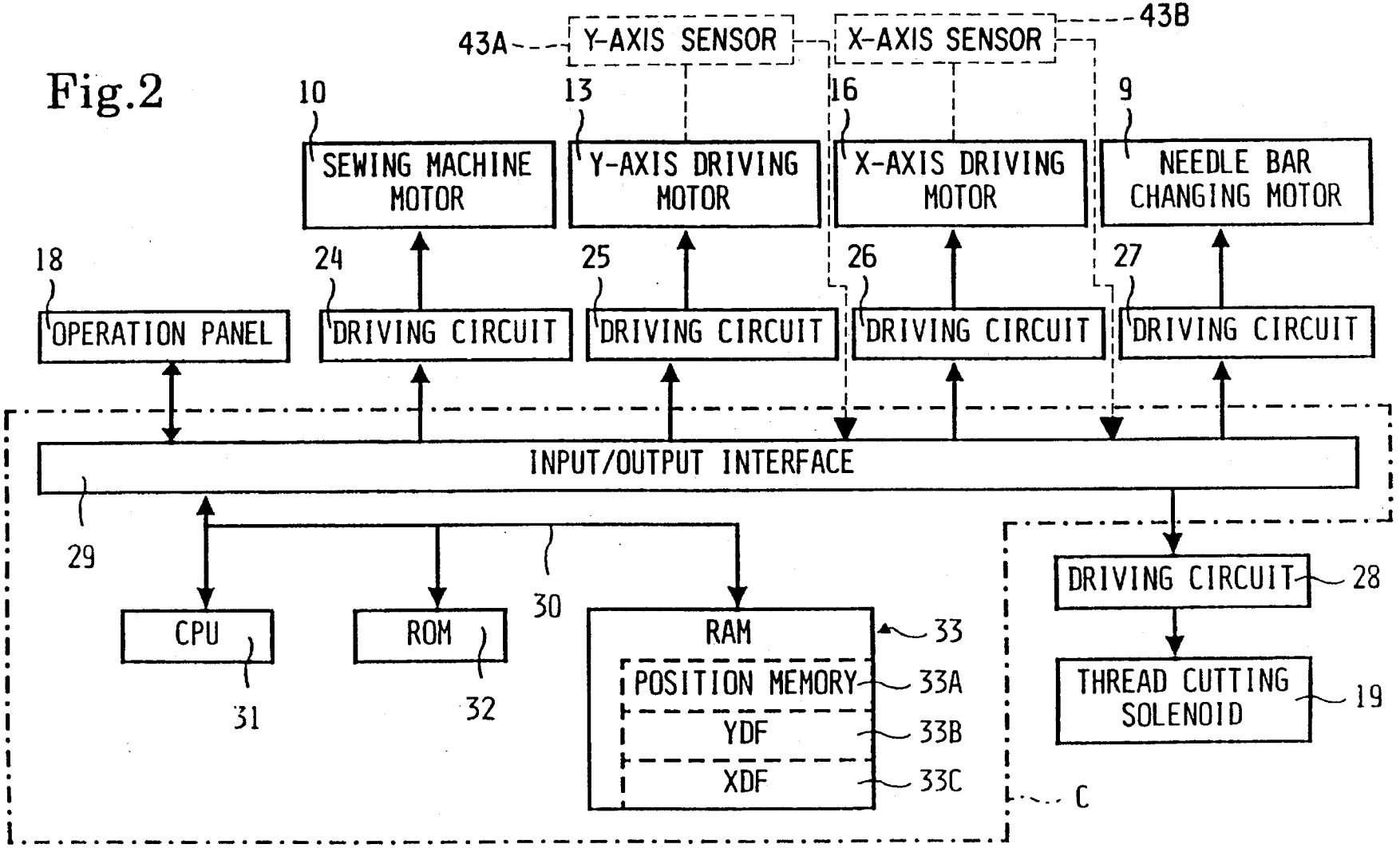
FIG. 2 is a block diagram of a control system for the multi-needle embroidery sewing machine.

Inside of the sewing machine table 2, a pair of Y direction moving arms (only one is shown) 12 are provided to be moved in a Y-axis direction (forward and backward directions) in an X-Y plane by a Y-axis driving motor 13 (see FIG. 2). The Y direction moving arms 12 extend upwardly at upper end portions thereof such that they are opposed to upper faces of the opposite right and left end portions of the sewing machine table 2.

A supporting member 14 is mounted at and between the upper ends of the Y direction moving arms 12 in pair and extends in the leftward and rightward directions. An X-axis moving arm 15 is mounted on the supporting member 14 such that it can be moved in an X-axis direction (leftward and rightward directions) in the X-Y plane by an X-axis driving motor 16 (see FIG. 2). Further, an embroidery frame 17 for removably receiving a work fabric thereon is mounted at a front end portion of the X direction moving arm 15. Accordingly, a work fabric received on the embroidery frame 17 is moved in the Y-axis direction by the Y direction moving arm 12 driven by the Y-axis driving motor 13 while it is moved in the X-axis direction by the X direction moving arm 15 driven by the X-axis driving motor 16 so that various embroidery patterns such as characters or figures can be formed on the work fabric.

A control system for the multi-needle embroidery sewing machine 1 is constructed as seen in FIG. 2. The operation panel 18, a driving circuit 24 for driving the sewing machine motor 10, another driving circuit 25 for driving the Y-axis driving motor 13, a further driving circuit 26 for driving the X-axis driving motor 16, a still further driving circuit 27 for driving the needle bar changing motor 9, and a yet further driving circuit 28 for driving a thread cutting solenoid 19 are connected to an input/output interface 29 of a control unit C.

The control unit C comprises a CPU 31, an input/output interface 29 connected to the CPU 31 by bus 30 such as a data bus, a ROM 32 and a RAM 33.

The ROM 32 has stored therein embroidery data for a large number of embroidery patterns, a control program for embroidery sewing control in accordance with which the Y-axis driving motor 13 and/or the X-axis driving motor 16 is driven based on the embroidery data to perform embroidery sewing, another control program for thread trimming control, described below, and some other necessary control programs.

The RAM 33 is provided with various memories including a working memory necessary for embroidery sewing of an embroidery pattern and memories for temporarily storing a result of calculation conducted by the CPU 31. In particular, the various memories include a position memory 33A for storing a position P(17) of the embroidery frame 17 in the X-Y plane as coordinate data, a moving direction flag YDF 33B and a moving direction flag XDF 33C. These moving direction flags 33B and 33C store data for the direction in which the embroidery frame 17 is to be moved.

Figure 4:
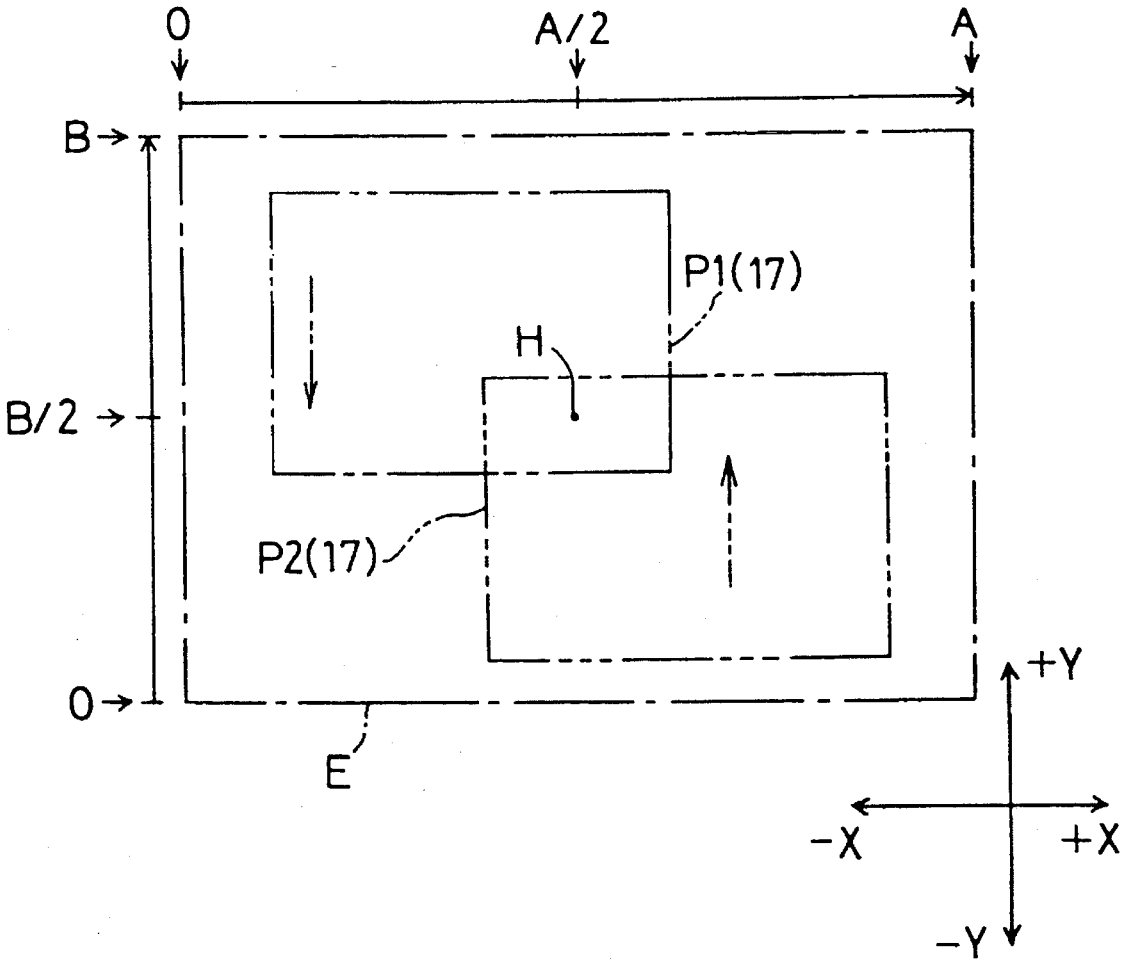
FIG. 4 is a diagrammatic view illustrating the positional relationship between an embroidery frame and a movable area of the embroidery frame.

By the way, a movable area E of the embroidery frame 17 has a rectangular profile as seen in FIG. 4, and the center of the embroidery frame 17 can move by a maximum distance "A" from the position "0" in the X-axis direction and can move by another maximum distance "B" from the position "0" in the Y-axis direction. The needle location of the sewing needle 6 is positioned at the center of the movable area E. An arbitrary moved position of the embroidery frame 17 in the movable area E is denoted by P(17). The moved position P(17) is shown with reference to the position of the center of the embroidery frame 17. Further, in the ROM 32 is stored the data of the maximum distance "A" in the X-axis direction and the data of the maximum distance "B" in the Y-axis direction. Also stored is a control program for position detection control for storing the moved position P(17) in the X-Y plane as coordinate data into the position memory 33A of the RAM 33 while updating the current position of the embroidery frame 17, which is moved by energization of the driving motors 13 and 16.

Figure 3A:
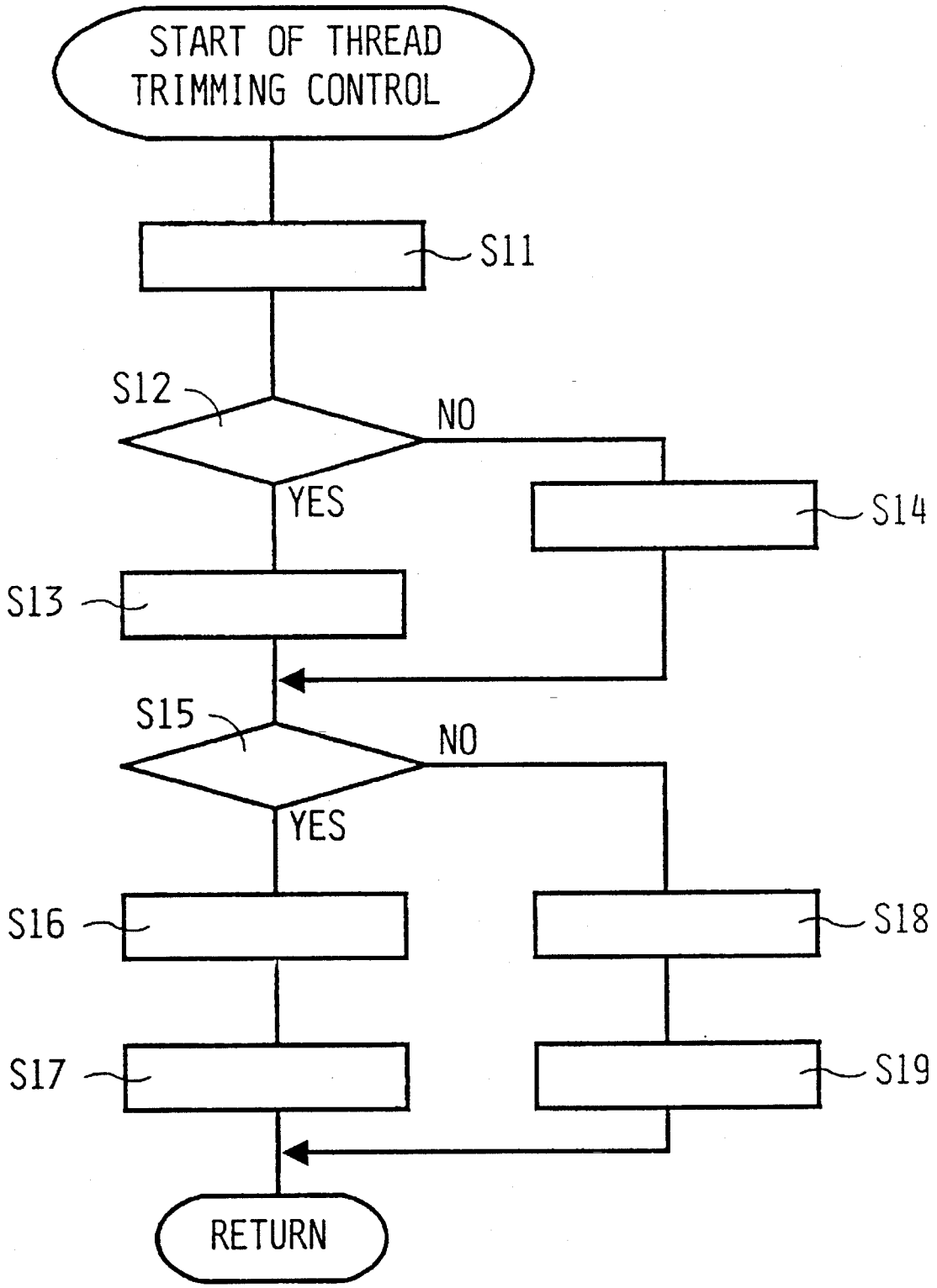
FIG. 3A is a general flowchart of a routine for thread trimming control.

Subsequently, a routine for the thread trimming control is executed by the control unit C of the multi-needle embroidery sewing machine 1 as described with reference to the flowchart of FIG. 3A. It is to be noted that reference characters Si (i=11, 12, 13, . . . ) denote operation steps.

The thread trimming control program is read out and executed when thread cutting control is executed during execution of the embroidery sewing control described above or when the embroidery sewing control comes to an end.

After the thread trimming control is started, position data P(a, b) of the moved position P(17) of the embroidery frame 17 are first read in from the position memory 33A of the RAM 33 (S11). Then, when the y coordinate value b of the position data is equal to or higher than B/2, that is, when the needle location H is positioned in a front half portion of the embroidery frame 17, for example, as at a moved position P1(17) of the embroidery frame 17 indicated by a two-dot chain line in FIG. 4 (S12: Yes), a moving direction flag YDF 33B for moving the embroidery frame 17 in the −Y direction is reset (S13).

Figure 5:
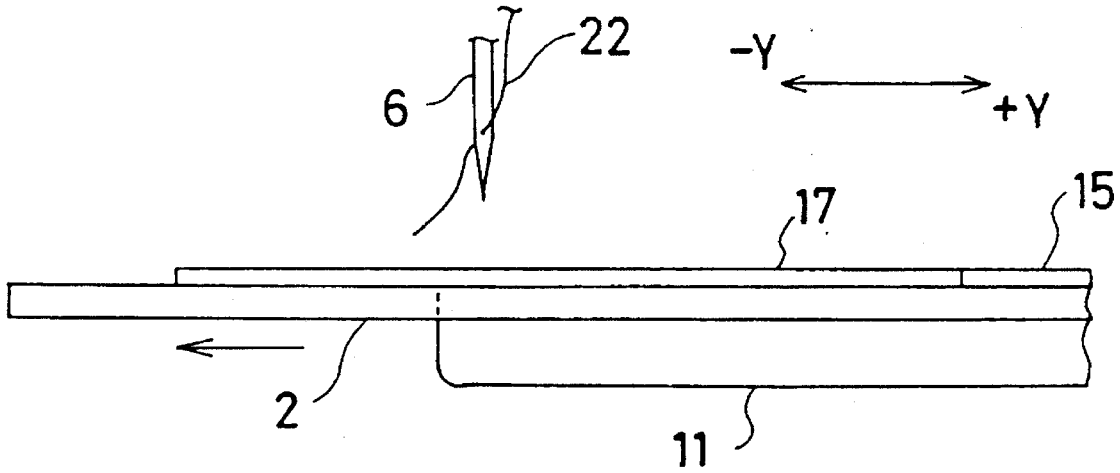
FIG. 5 is a partially enlarged side view of a cylinder head.

When the moving direction flag YDF 33B is in a reset condition (S15: No), the Y-axis driving motor 13 is driven so that the embroidery frame 17 may be moved by a predetermined distance (for example, about 5 cm) in the −Y direction (S18). In this instance, since the embroidery frame 17 is moved by the predetermined distance without fail in the −Y direction, that is, in a direction in which the needle location H moves toward the center of the embroidery frame 17 in the Y-axis direction as shown in FIGS. 4 and 5, an end portion of the embroidery thread 22 extending from the sewing needle 6 is certainly trimmed from the work fabric.

Subsequently, the embroidery frame 17 is moved by the predetermined direction in the opposite +Y direction to return to its original moved position (S18), thereby completing the present control to return to a main routine.

On the other hand, if the y coordinate value b of the position data of the moved position P(17) of the embroidery frame 17 is lower than B/2 when the present control is started, that is, if the needle location H is positioned in a rear half portion of the embroidery frame 17, for example, as at a moved position P2(17) of the embroidery frame 17 indicated by a three-dot chain line in FIG. 4 (S12: No), the moving direction flag YDF 33B is set (S14).

Then, when the moving direction flag YDF 33B is in a set condition (S15: Yes), the Y-axis driving motor 13 is driven so that the embroidery frame 17 may be moved by the predetermined distance in the +Y direction (S16). In this instance, since the embroidery frame 17 is certainly moved by the predetermined distance in the +Y direction, that is, in a direction in which the needle location H moves toward the center of the embroidery frame 17 in the Y-axis direction, an end portion of the embroidery thread 22 extending from the sewing needle 6 is trimmed from the work fabric with certainty.

Thereafter, the embroidery frame 17 is moved by the predetermined distance in the opposite −Y direction, to return to its original moved position (S17). Thereby, the present control is completed to return to the main routine.

Figure 6A:
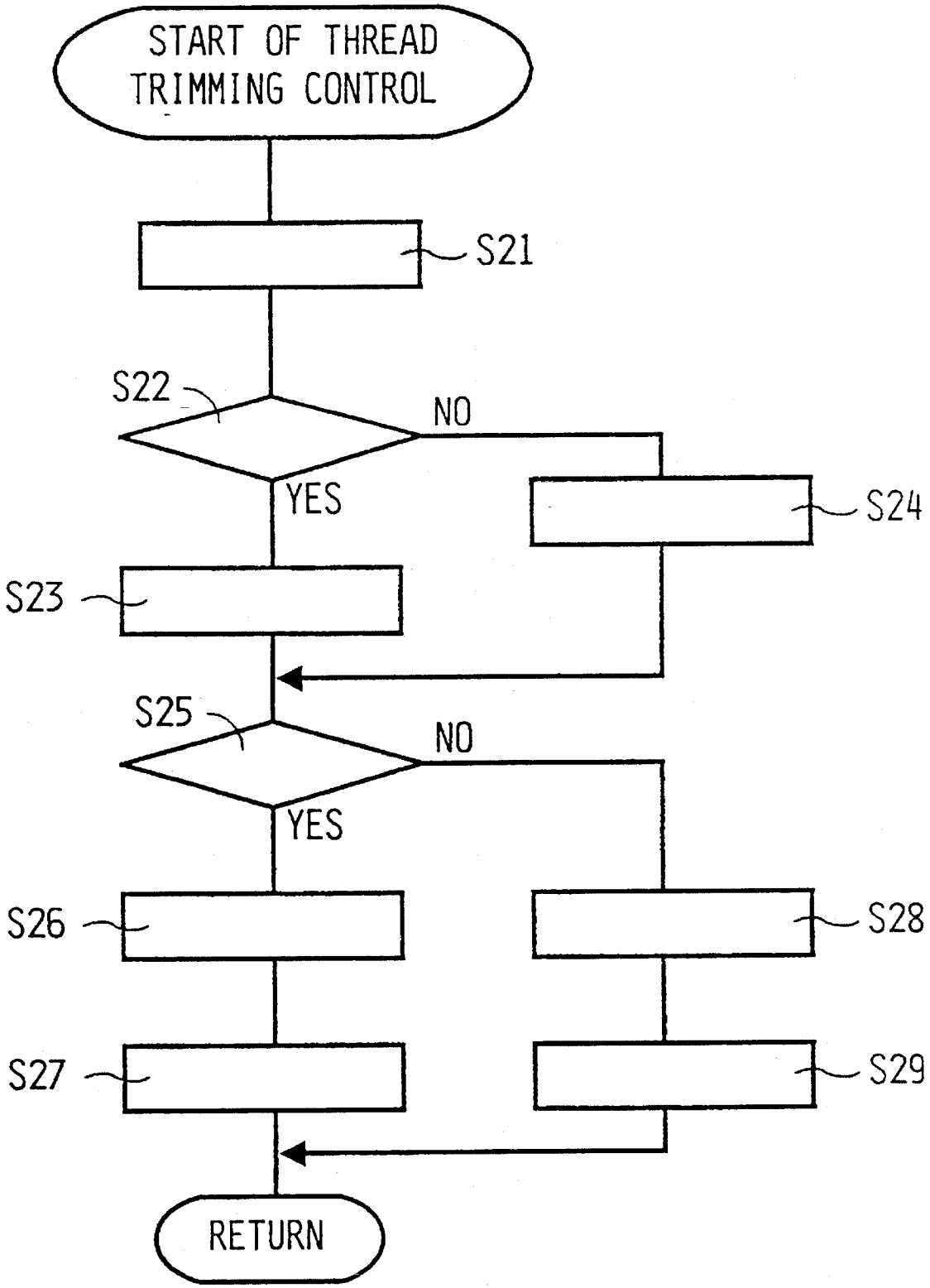
FIG. 6A is a flowchart, similar to FIG. 3A, of a modified routine for thread trimming control.

By the way, the thread trimming control described above with reference to FIG. 3A may be modified as illustrated in the flowchart of FIG. 6A such that the embroidery frame 17 is moved by the predetermined distance in the leftward and rightward directions to effect the thread trimming control.

In particular, referring to FIG. 6A, when the x coordinate value a of the position data of the moved position P(17) of the embroidery frame 17 is equal to or higher than A/2, that is, when the needle location H is positioned in a left half portion of the embroidery frame 17 (S22: Yes), a moving direction flag XDF 33C is reset (S23). Then, the embroidery frame 17 is moved by a predetermined distance in a −X direction and moved by the predetermined distance in the opposite +X direction (S28 and S29). Whereafter, thread trimming of an end portion of the embroidery frame 22 extending from the sewing needle 6 is performed.

On the other hand, when the x coordinate value a of the position data of the moved position P(17) of the embroidery frame 17 is lower than A/2, that is, when the needle location H is located in a right half portion of the embroidery frame 17 (S22: No), the moving direction flag XDF 33C is set (S24). Then, the embroidery frame 7 is moved by the predetermined distance in the +X direction and moved by the predetermined distance in the −X direction (S28 and S27). Whereafter, thread trimming of an end portion of the embroidery thread 22 extending from the sewing needle 6 is executed.

Figure 7A:
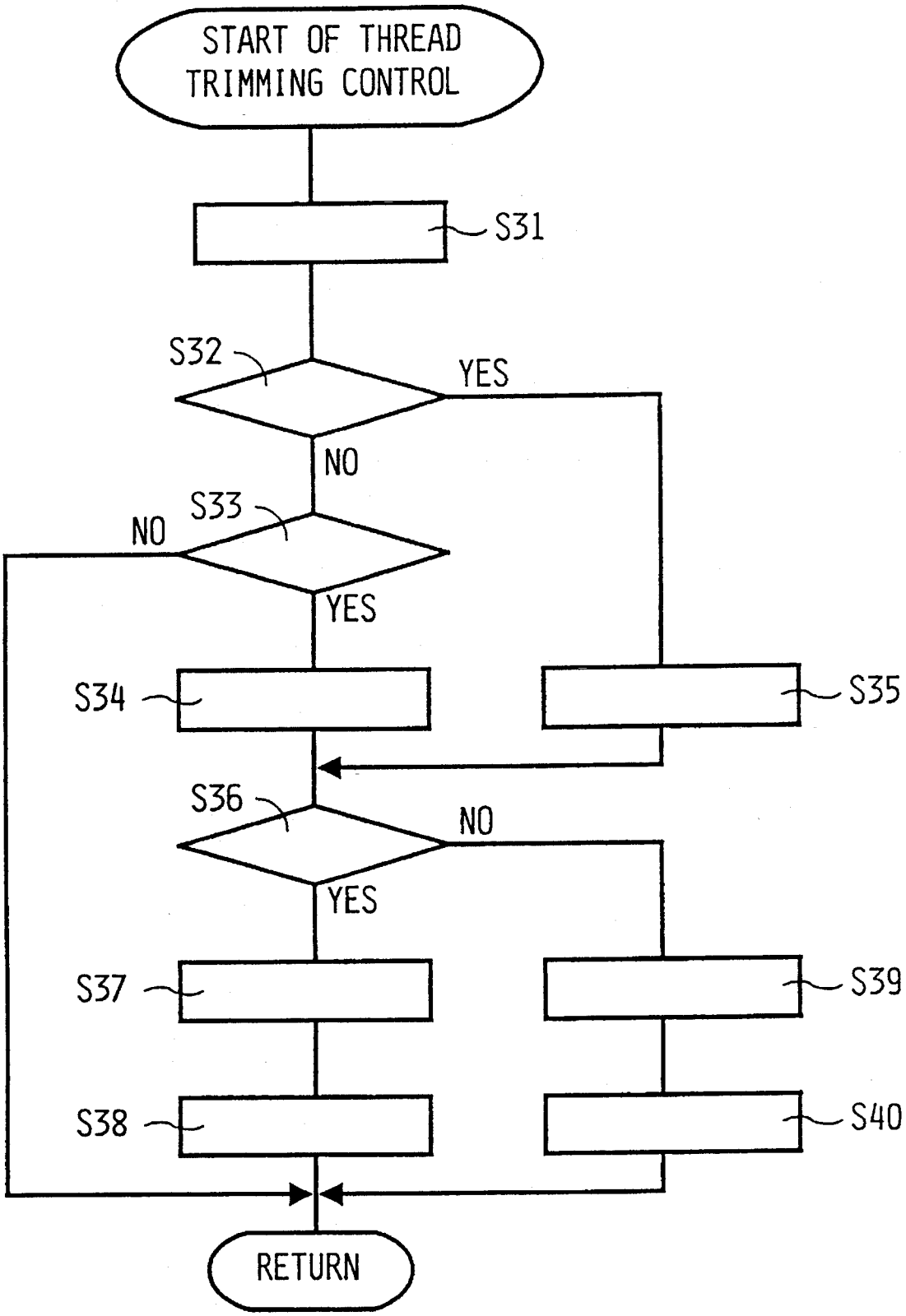
FIG. 7A is a flowchart, similar to FIG. 3A of another modified routine for thread trimming control.

By the way, the thread trimming control described above with reference to FIG. 3A may be alternatively modified in such a manner as illustrated in the flowchart of FIG. 7A wherein, when the needle location H is positioned in the proximity of a rear end or a front end of the embroidery frame 17, the embroidery frame 17 is moved by a predetermined distance in the rearward or forward direction to effect the thread trimming control.

In particular, referring to FIGS. 7A and 7B, when a y coordinate value b of the position data of the moved position P(17) of the embroidery frame 17 is equal to or lower than a predetermined distance α (S32: Yes), the moving direction flag YDF 33B is set (S35). Then, the embroidery frame 17 is moved by the predetermined distance in the +Y direction and moved by the predetermined distance in the −Y direction (S37 and S38). Finally, thread trimming of an end portion of the embroidery thread 22 extending from the sewing needle 6 is performed.

On the other hand, when the y coordinate value b of the position data of the moved position P(17) of the embroidery frame 13 is within a range from a maximum distance B to another distance smaller by the predetermined distance a from the maximum distance B both inclusive (S32: No, S33: Yes), the moving direction flag YDF 33B is reset (S34). The embroidery frame 17 is moved by the predetermined distance in the −Y direction and then moved by the predetermined distance in the +Y direction (S39 and S40). Whereafter, thread trimming of an end portion of the embroidery thread 22 extending from the sewing needle 6 is performed.

Figure 8A:
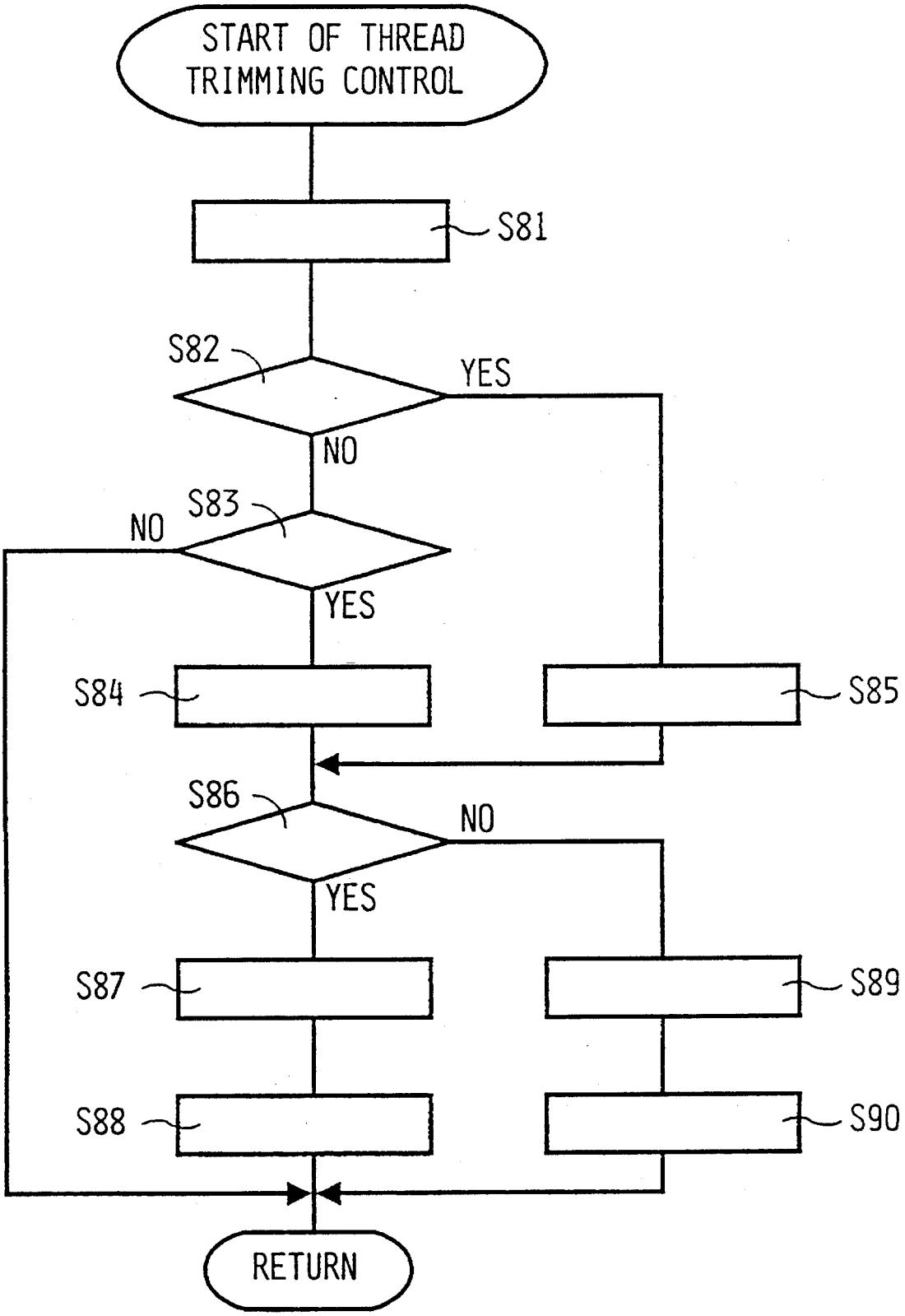
FIG. 8A is a flowchart, similar to FIG. 3A, of a further modified routine for thread trimming control.

Further, the thread trimming control illustrated in FIG. 7A may be further modified as illustrated in FIG. 8A such that, when the needle location H is positioned in the proximity of a right end portion or a left end portion of the embroidery frame 17, the embroidery frame 17 is moved by a predetermined distance in the rightward or leftward direction, to execute the thread trimming control.

In this instance, moving control of the embroidery frame 17 is executed attending to the x coordinate value a of the position data of the moved position P(17) of the embroidery frame 17. Accordingly, in the moving control illustrated in FIG. 8A, such control of an outline as in steps S82 to S90 is performed for the X-axis direction and the moving direction flag XDF 33C in place of the control for the Y-axis direction and the moving direction flag YDF 33B executed in steps S32 to S40 of FIG. 7A.

On the other hand, when the needle location H is positioned in the proximity of a periphery of the embroidery frame 17, the driving motors 13 and 16 may be driven to move the embroidery frame 17 so that the needle location H may move toward the center of the embroidery frame 17 to perform thread trimming of an end portion of the embroidery thread 22 extending from the sewing needle 6.

It is to be noted that it is also possible to detect the moved position of the embroidery frame 17 by counting a slit signal by means of an optical sensor 43A,43B (as shown in broken lines in FIG. 2) such as a photo-interrupter when an encoder disk connected to the X-axis driving motor 16 or the Y-axis driving motor 13 is rotated. Further, it is possible to store a plurality of different sizes of the movable area E of the embroidery frame 17 in the ROM 32 or a like storage member for different types of the embroidery frame 17 to be used. Where the movable frame to be driven to move is constructed so as to receive a plurality of different embroidery frames thereon, the moving direction of the movable frame may be determined in accordance with the movable frame and a movable area of the movable frame. Further, the present invention can be naturally applied to control apparatus for various embroidery sewing machines that include an embroidery frame or frames and/or a movable frame or frames.

What is claimed is:

1. A control apparatus for a sewing machine, the sewing machine including a sewing needle, a frame driving means for driving a movable frame means for mounting a workpiece thereon within a limited movable area, and a thread cutting means for cutting a thread supplied to the sewing needle, comprising:

a position detection means for detecting a current position of the movable frame means;

a moving direction determination means coupled to a position detection means for determining the thread trimming direction for moving the movable frame means for thread trimming based on the current position of the movable frame means detected by the position detection means and the limited movable area of the movable frame means; and a controlling means coupled to the moving direction determination means for controlling the frame driving means to move the movable frame means in the thread trimming direction determined by the moving direction determination means during a thread trimming operation.

2. The control apparatus of claim 1, wherein the controlling means includes a distance control means for controlling the frame driving means to move the movable frame means by a predetermined thread trimming distance in the thread trimming direction.

3. The control apparatus of claim 2, wherein the moving direction determination means determines the thread trimming direction so that the movable frame means moved in the thread trimming direction by the predetermined thread trimming distance is within the limited movable area.

4. The control apparatus of claim 1, wherein the moving direction determination means determines the thread trimming direction so that an outer edge of the movable area of the movable frame means nearest to the sewing needle is spaced from the sewing needle when the movable frame means is moved in the thread trimming direction.

5. The control apparatus of claim 4, wherein the controlling means includes a distance control means for controlling the frame driving means to move the movable frame means by a predetermined thread trimming distance in the thread trimming direction.

6. The control apparatus of claim 1, wherein said controlling means controls the frame driving means to drive the movable frame means back to its original position determined by the position detection means after the thread trimming operation is completed.

7. A sewing machine comprising:

a needle sewing mechanism;

a movable frame for supporting a workpiece located beneath the needle sewing mechanism;

a thread cutting mechanism located adjacent the needle sewing mechanism;

a drive mechanism coupled to the movable frame for moving the frame with respect to the needle sewing mechanism; and a controller coupled to the needle sewing mechanism, the movable frame, the thread cutting mechanism and the drive mechanism, comprising a memory that stores position data for the movable frame including a maximum distance the frame can move with respect to the needle sewing mechanism, a position detector coupled to the movable frame that detects a position of the movable frame upon commencement of a thread trimming operation, a determiner coupled to the position detector and the memory that determines a thread trimming direction and distance for the movable frame based on the detected position and the stored position data of the movable frame, and a drive controller coupled to the determiner that controls the drive mechanism to drive the movable frame in the determined thread trimming direction and distance during the thread trimming operation.

8. The sewing machine of claim 7 wherein the drive mechanism includes an X direction driver and a Y direction driver that is perpendicular to the X direction, and wherein the determiner determines in which direction to move the frame.

9. The sewing machine of claim 7 wherein the drive controller controls the drive mechanism to drive the movable frame back to its original position determined by the position detector after the thread trimming operation is completed.

10. The sewing machine of claim 7 wherein the determiner determines the direction and distance for the movable frame with respect to a central position of the needle sewing mechanism with respect to the frame.

11. The sewing machine of claim 7 wherein the determiner determines the direction and distance for the movable frame with respect to an edge of the frame.

12. The sewing machine of claim 7, wherein the needle sewing mechanism comprises a multi-needle sewing assembly.

13. The sewing machine of claim 7, wherein the movable frame is an embroidery frame.

14. A method of controlling an embroidery sewing machine having a needle, a movable frame and a thread trimming mechanism, comprising the steps of:

storing data including distance data for the movable frame corresponding to a maximum distance the frame can be moved with respect to the needle;

detecting a position of the movable frame upon commencement of a thread trimming operation;

determining a thread trimming direction and distance based on the detected position of the movable frame and the distance data for the movable frame; and controlling movement of the frame during the thread trimming operation based on the determined thread trimming direction and distance.

15. The method of claim 14 wherein determining the thread trimming direction and distance includes determining a direction in an X and Y plane.

* * * * *